United States Patent [19]

Frantz et al.

[11] 4,336,821

[45] Jun. 29, 1982

[54] SOLENOID-ACTUATED DRAIN VALVE

[75] Inventors: Virgil L. Frantz, Salem; Thomas D. Taylor, Roanoke, both of Va.

[73] Assignee: Graham-White Sales Corporation, Salem, Va.

[21] Appl. No.: 194,992

[22] Filed: Oct. 8, 1980

[51] Int. Cl.[3] ..... F17T 1/00

[52] U.S. Cl. ..... 137/187; 137/204; 137/392; 137/624.13

[58] Field of Search ..... 137/204, 187, 172, 392, 137/624.13, 396

[56] References Cited

U.S. PATENT DOCUMENTS

| | | | |
|---|---|---|---|
| 2,564,873 | 8/1951 | Wright | 137/187 |
| 3,262,464 | 7/1966 | Frantz | 137/204 |
| 3,575,199 | 4/1971 | Beattie | 137/203 X |
| 4,137,934 | 2/1979 | Rice | 251/282 X |
| 4,261,382 | 4/1981 | Bridges | 137/204 X |

*Primary Examiner*—Alan Cohan

*Attorney, Agent, or Firm*—Wilmer Mechlin

[57] ABSTRACT

A solenoid-actuated drain valve for a compressed gas reservoir of a diesel locomotive in which the valve element is a differential piston exposed on opposite faces to reservoir pressure for normally holding the valve closed and minimizing the opening force required to be exerted by the solenoid, a temperature-responsive heating element protects the valve against freezing, a sensing element senses accumulations of water from the compressed gas in the reservoir, and actuation of the heater and energizing of the solenoid for opening the valve are both controlled by a solid state circuit which prevents opening of the valve except when the sensing element senses accumulated water.

10 Claims, 4 Drawing Figures

SOLENOID-ACTUATED DRAIN VALVE

BACKGROUND OF THE INVENTION

With time, reservoirs of compressed gas systems accumulate by condensation or separation from the contained compressed gas, mainly liquid matter which in diesel locomotive or other vehicular compressed air systems, usually contains some oil but is predominantly water. If the accumulated liquid is not periodically drained from a reservoir of such a system, it and any entrained solid particles, can corrode, clog or otherwise damage mechanisms operated by the compressed air or other gas from the reservoir. It therefore is customary to fit such a reservoir with a drain valve for periodically and preferably automatically draining the accumulated matter. Exemplary of such drain valves is that of Frantz U.S. Pat. No. 3,262,464, in which a valve member in the form of a differential piston normally held closed by a return spring, is opened for draining accumulated matter from a reservoir on each idling cycle of an associated compressor by actuating compressed gas supplied by the compressor's unloader or governor line. While that patent also suggests that the drain valve might be operated automatically by a timer-controlled solenoid, if, as in that patent, the only force normally holding the valve closed is that of the return spring and if, as in a diesel locomotive, the maximum reservoir pressure is about 140 p.s.i.g., the required opening force would be beyond the capacity of the usual single coil solenoid. Other problems confronted in drain valves for compressed gas reservoirs are freezing if the valve is exposed at times to ambient freezing temperatures and excessive loss of reservoir pressure, if, as heretofore, the valve is opened automatically at predetermined intervals without regard to the presence of any accumulated matter. It is to these and other problems confronted in adapting a drain valve for a compressed gas reservoir to solenoid actuation that the present invention is particularly directed.

SUMMARY OF THE INVENTION

The primary object of the present invention is to provide an improved solenoid-actuated drain valve for a reservoir of a compressed gas system which is adapted to sense the presence of predominantly aqueous or other conductive liquid matter accumulated from the gas in the reservoir and is opened by energizing of the solenoid only when liquid matter is sensed.

Another object of the invention is to provide an improved solenoid-actuated drain valve of the character described in the preceding object in which in the presence of accumulated liquid matter, the valve cyclically opens and closes for draining the liquid matter with a minimum loss of reservoir pressure.

An additional object of the invention is to provide an improved solenoid-actuated drain valve for a reservoir of a compressed gas system which can open only upon sensing the presence of accumulated liquid matter, is protected against freezing by a temperature-responsive heater element and includes a solid state circuit for controlling both actuation of the heater element and cyclic opening and closing of the valve for draining the accumulated liquid matter.

A further object of the invention is to provide an improved solenoid-actuated drain valve for a compressed gas reservoir of the character described in any of the preceding objects, wherein the valve member of the valve is a differential piston exposed on opposite faces to reservoir pressure for normally holding the element closed and minimizing the opening force required to be exerted by the solenoid.

Other objects and advantages of the present invention will appear hereinafter in the detailed description, be particularly pointed out in the appended claims and be illustrated in the accompanying drawings, in which:

FIGURE DESCRIPTION

DETAILED DESCRIPTION

Figure 1:
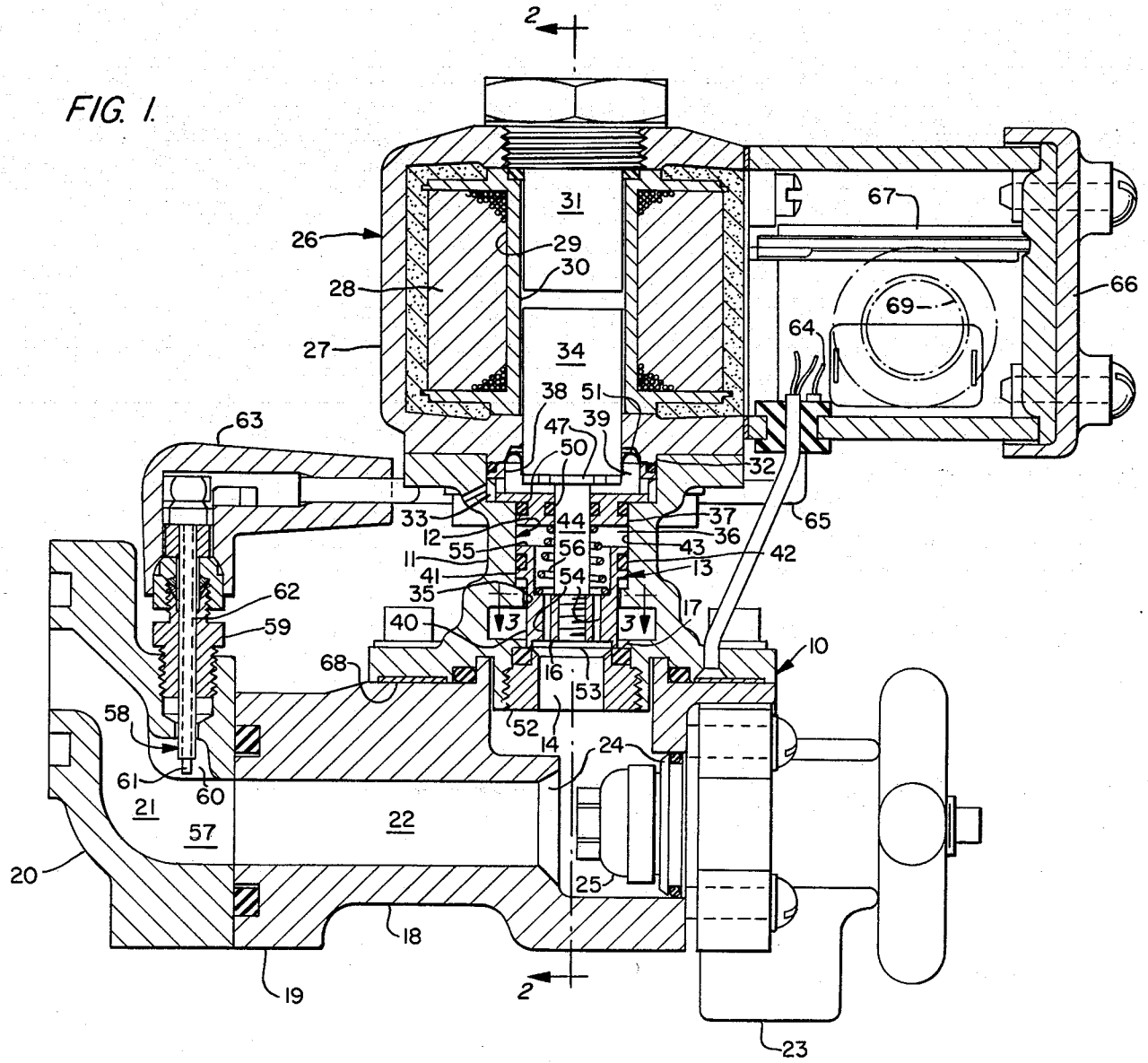
FIG. 1 is a central vertical sectional view of a preferred embodiment of the solenoid-actuated drain valve of the present invention.
Figure 2:
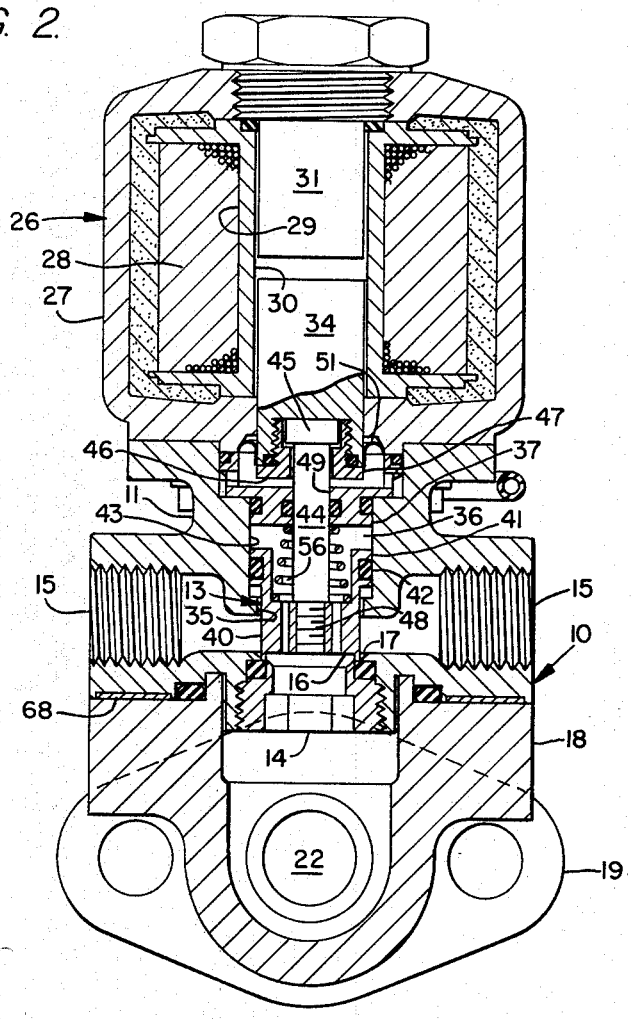
FIG. 2 is a vertical sectional view taken along lines 2—2 of FIG. 1.
Figure 3:
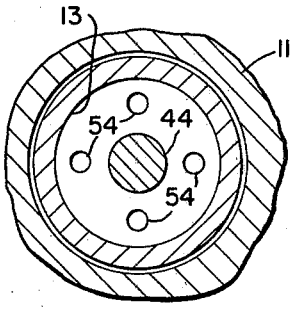
FIG. 3 is a fragmentary horizontal sectional view taken along lines 3—3 of FIG. 1.

Referring now in detail to the drawings in which like reference characters designate like parts, the improved solenoid-actuated drain valve of the present invention is adapted for draining from a reservoir of a compressed gas system, mainly liquids and solid particles entrained therein accumulated by condensation or gravity separation from the gas in the reservoir and is particularly suited for draining a reservoir of a compressed gas system, such as the compressed air system of a diesel locomotive, in which the accumulated matter is predominantly water or other electrically conductive liquid and the structure mounting the drain valve carries a positive electrical charge derived from the dc power supply of an electrical circuit responsible for energizing the valve's solenoid. As exemplary of a suitable ambience, the improved drain valve therefore will be particularly described with reference to a diesel locomotive.

Designated as 10, the improved solenoid-actuated drain valve of the present invention is comprised of a body or casing 11, housing or containing in an axial or central bore 12 extending vertically therethrough, a vertically or axially shiftable or reciprocable valve member or element 13. As porting, the body 11 has in its inner end or bottom a downwardly or inwardly opening inlet port 14 coaxial with the bore 12 and one or preferably a pair of diametrically opposed, horizontally disposed drain ports 15 extending radially from the bore to the outside of the body and the valve member 13 normally closes or blocks communication between the inlet and drain ports by seating of its lower or inner end 16 downwardly or inwardly against a valve seat 17 about or surrounding the upper end of the inlet port.

Designed in operation to be in constant fluid-connection to or communication with the interior of the compressed gas reservoir (not shown) to which it is applied for automatically draining at intervals condensate or other accumulated matter therefrom, the valve body 11 is suitably so connected by being bolted or otherwise mounted on a base or mounting bracket 18 conveniently having at an inlet end a flanged fitting 19 preferably boltable through an interposed adapter 20 to a like fitting about an outlet in the side of a compressed gas reservoir (not shown) adjacant the bottom thereof. A passage 21 through the adapter 20 and connecting outlet passage 22 in the mounting bracket 18 fluid-connect the reservoir's outlet to the inlet port 14 of the body 11. For closing the outlet passage 22 for periodic inspection and maintenance of the automatic solenoid-actuated valve, as well as to permit emergency manual draining of the reservoir, the mounting bracket 18, as in the automatic drain valve of Frantz U.S. Pat. No. 3,262,464, preferably has its own downwardly opening outlet port 23 and a pair of opposed valve seats 24, one leading to that outlet port and the other in the passage 22, and a double-headed valve 25 shiftable for alternate seating in the seats or positioning therebetween, the latter for draining the reservoir through the bracket's outlet port.

Mounted on the mounting bracket 18 and therethrough conveniently on the reservoir to which the drain valve 10 is applied, the valve body 11 in turn mounts a solenoid 26, operable on being energized for draining accumulated matter from the reservoir through the drain ports 15 by unseating the valve member 11 from its seat 17. The solenoid 26 has a housing 27 containing a coil 28 wound on a spool or bobbin 29, the coil being impregnated and the spool and coil encapsulated to lock or anchor them in place by injecting epoxy or like resin into the housing while they are temporarily positioned in the housing by positioning pins (not shown) inserted into opposite ends of the spool's cylindrical central aperture 30. Thereafter, the positioning pins are removed and a coil or core pole 31, extending from above or inwardly into the spool's central aperture 30, is screwed into the top of the housing 27.

Mounted, as by bolting, on the top or outer end of the valve body 11, the solenoid housing 27, for centering the spool's central aperture 30 on the axial bore 12 of the valve body, conveniently has a cylindrical boss 32 depending or extending from the bottom or inner end of the housing and fitting or seating in a conforming socket 33 in the top or outer end of the valve body 11 at the upper or outer end of and coaxial with and of larger diameter than the axial bore. Extending into and sliding in the lower or inner portion of the central aperture 30 of the spool 29 and inserted thereinto before mounting the solenoid housing 27 onto the valve body, is a solenoid plunger or armature 34 which projects through the bottom or inner end of the housing into the socket 33.

In the drain valve of this invention, the valve member or element 13 is a differential piston having both ends exposed to reservoir pressure, with the area of the upper or outer end the larger so that the consequent differential force derived from the reservoir pressure on both will exert a downward or inward force for normally holding the valve closed with the valve member's lower or inner end 16 seated against the valve seat 17. For accommodating the valve member 13, the axial bore 12, intermediate its ends, is divided vertically or axially into lower or inner and upper or outer chambers or compartments of different diameter, the lower or smaller, a valve chamber 35 extending upwardly or outwardly from the valve seat 17 and onto which the drain ports 15 open, and the upper or larger, a pressure chamber 36 sealed closed at the top or outer end by a plug, separator or wafer 37. Extending downwardly or inwardly into the pressure chamber 36, the plug 37 has at its top or outer end a radially outstanding peripheral flange 38 upstanding into the socket 33 and bounding a cavity 39 therein containing the lower end of the plunger 34, the plug conveniently being held in place by end-engagement with the boss 32 on the solenoid housing 27.

Slidable or reciprocable axially or vertically in the axial bore 12, the preferred valve member 13 has as a lower or inner part a stem 40 in the valve chamber 35 and a head 41 of larger diameter contained in the pressure chamber 36 and suitably carrying or mounting peripherally an O-ring 42 for sealing engagement with the pressure chamber's side or side wall 43. The valve member 13 and solenoid plunger 34 are operatively connected, suitably by a connecting bolt 44 coaxial therewith and having a headed upper or outer end 45 received and releasably secured in the lower or inner end of the plunger, as by a cap or nut 46 screwed into the plunger's lower end and having as an integral, exposed, wrench-applying inner end a hex-flange 47, and a threaded lower end portion 48 threaded or screwed into the valve member and therebetween smooth-shanked for passing through a central opening 49 in the plug 37. For sealing between itself and both the connecting bolt 44 and the side 43 of the pressure chamber 36, the plug 37 suitably is fitted with or carries inner and outer O-rings 50.

While the O-ring seals on the plug 37 and radial porting of the flange 38 for draining pressure from the cavity 39 in the flange, ordinarily will suffice for preventing leakage of compressed fluid around the plunger 34 into the central aperture 30 of the spool 29, the improved valve preferably further ensures against such leakage by a flexible diaphragm 51 clamped peripherally between the flange and the boss 32 on the solenoid housing 27 and inwardly between the plunger 34 and its cap 46. As indicated, the fit between the cap 46 and bolt 44 is a loose or floating fit to accommodate any relative angling or lateral movement of plunger 34 and valve member 13.

The preferred valve seat 17 is an annular gasket of rectangular cross-section held in place by an externally-threaded, annular or hollow nut 52, the center opening of which serves as the inlet port 14 of the valve body 11. Otherwise preferably flat, the lower or inner end 16 of the valve member 13 presents for sealing engagement with the preferred gasket seat 17 a downstanding or instanding, outwardly tapering marginal flange 53. With the drain ports 15 and inlet port 14 fluid-connected through the valve chamber 35 when the valve member 13 is unseated or shifted to open position by the plunger 34 on energizing of the solenoid 26, if, as intended, the valve member in response to reservoir pressure, is to act as a differential piston and be urged toward and held in seated or closed position against the gasket seat for closing the drain ports from the inlet port when the solenoid is deenergized, it is necessary that the pressure chamber 36 be constantly open to reservoir pressure. This preferably is accomplished by fluid-connecting the pressure chamber 36 to the inlet port 14 either through the valve body 11 around the valve member 13 or, as shown, through the valve member, suitably by a plurality of circumferentially spaced passages, ways, ports or drillings 54 extending axially or vertically through the valve member about and outwardly of the bolt 44.

With the inlet port 14, during automatic operation of the improved drain valve, constantly exposed to reservoir pressure through the mounting bracket 18 and that pressure applied to both the lower end or end surface 16 and, through the axial passages or ports 54, the opposed or oppositely facing upper end or end surface 55 of the valve member 13, since the area of the exposed or presented surface of the upper end is greater than that of the lower end, so long as the reservoir is pressurized, the valve member 13 will be subjected by reservoir pressure to a force differential exerting thereon a positive force in a closing direction. This action of the reservoir pressure on the valve member 13 has two beneficial results: one, that regardless of how high the reservoir pressure may be, so long as the pressure is substantial, it will exert a positive closing force on the valve member, and the other, that since not required to oppose and overbalance reservoir pressure, the closing force on the valve member sufficient to normally close the inlet port 14, can be well within the range of the opening force exertable on the valve member by a conventional single-coil solenoid, such as the illustrated solenoid 26.

While the resultant or differential downward or inward force exerted by reservoir pressure is otherwise effective for normally closing and holding the valve member 13 closed when the solenoid is deenergized, if for any reason pressure in the reservoir or the compressed gas system of which it is a part, has been bled or is substantially exhausted, as during the initial stages of the subsequent pump-up or buildup of pressure in the reservoir, it is essential that the drain valve 10 be held closed but the force differential exertable on the valve member 13 will be insufficient for the purpose. To compensate for this deficiency, the drain valve 10 includes a return spring 56, acting downwardly or inwardly between the stationary plug 37 and the valve member 13 for exerting on the valve member a closing force sufficient only to ensure that the valve member will remain closed during periods of no or very low pressure in the reservoir. To fit in the valve member 13 and within the pressure chamber 36, the preferred weak return spring 56 is a fructo-conical or upwardly tapered coil spring having its smaller end engaging and reacting upwardly against the plug 37 and its larger end socketed in the valve member outwardly of the passages 54.

As opposed to the conventional arrangement in which a mounting bracket of a drain valve is connected to an outlet adjacent the bottom of the associated reservoir (not shown) and the mainly liquid matter released or separated from the compressed gas accumulates in the reservoir, as previously mentioned, the mounting bracket 18 in the drain valve of this invention preferably is connected to the reservoir's outlet by an adapter 19. Generally of Z-shape with the passage 21 therethrough of corresponding shape and both lower at or offset downwardly toward their outlet ends, the outlet portion of the adapter's passage and connected outlet passage 22 together not only form a sump 57 for collecting or accumulating by gravity flow the matter otherwise accumulated in the reservoir, but by downwardly offsetting the drain valve, markedly reduce the overhead clearance required for its installation. For sensing the presence of water or other electrically conductive accumulated matter in the sump 57, the improved drain valve includes a sensor, sensing element or probe 58, conveniently mounted by a fluid-tight connector or fitting 59 in the top wall of the lower or downwardly offset outlet portion of the adapter 20 and projecting into a downwardly opening recess 60 in that wall. If, as in a diesel locomotive, a frame (not shown) mounting the reservoir and drain valve 10 carries a dc electrical charge, the probe 58 may have the illustrated single and otherwise will have a pair of spaced electrodes 61 encased intermediate its or their ends in an insulating tube 62 extending therewith upwardly through the connector 59, and the or each electrode presents an exposed lower end for sensing matter accumulated above a predetermined level in the sump 57. The one or more electrodes 61 and casing 62 extend upwardly above the connector 59 suitably into a gooseneck fitting attached to and surmounting the connector 59, within which the or each electrode is connected to a lead 64 leading through protective tubing 65 into a junction box 66 attached to a side of the solenoid housing 27 and containing a control circuit 67 to which the lead or leads are connected in the manner hereinafter to be explained.

If in a particular installation the drain valve 10 on occasion is to be exposed to freezing temperatures, a desirable addition to prevent the valve from freezing is a heater 68, suitably in the form of an annular gasket embedding a heater coil (not shown) and interposed about the inlet port 14 between the valve body 11 and mounting bracket 18 and connected through the control circuit 67 to a main supply line 69 led into the junction box 66.

Figure 4:
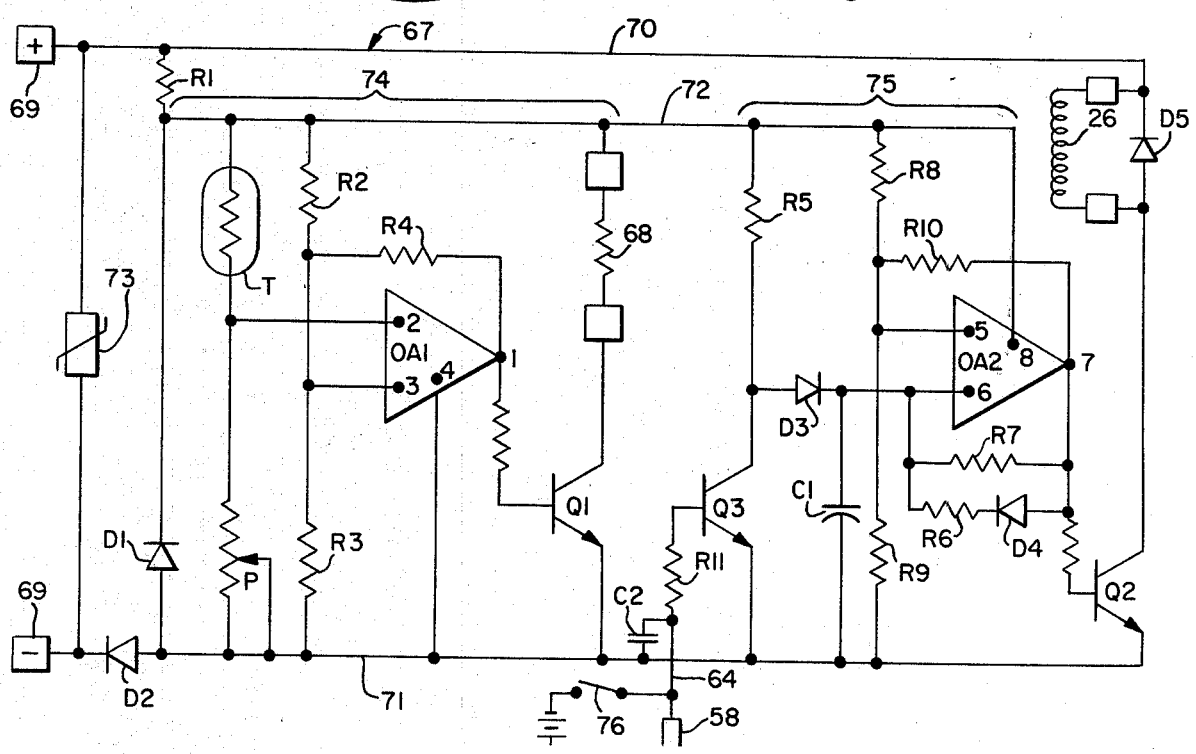
FIG. 4 is a wiring diagram of a solid state circuit suitable for controlling the operation of the valve.

In its automatic operation, the improved drain valve 10 is designed to open only when the probe 58 senses by contact the presence to its level of accumulated matter in the sump 57 and then to cyclically open and close in response to energizing and deenergizing of the solenoid 26 until the accumulated matter has been drained below the probe's sensing level. Additionally, if the drain valve includes a heater 68, the heater, too, is designed to be turned on and off automatically to suit the ambient temperature to which the valve is exposed. A control circuit 67 suitable for automatically performing these functions is the solid state control circuit illustrated by the wiring diagram of FIG. 4 and conveniently in the form of a printed circuit seated or received in the junction box.

As exemplary of installations of the improved drain valve 10, the preferred solid state control circuit 67 will now be particularly described with reference to a diesel locomotive in which the available power supply is 74 v. dc, the frame and components mounted thereon carrying an induced charge of about 37 v. dc (substantially halfway between the 74 v. dc supply voltage and ground), the stated resistances are suitable rather than essential and the matter separated from the compressed air in the reservoir and accumulated in the sump 57 is mainly water and electrically conductive. Connected on its main positive side 70 to the 74 v. dc power supply and on its negative or ground side 71 to ground, the control circuit 67 provides a regulated 24 v. dc power supply to its components other than the solenoid 26 by tapping a secondary positive side 72 to a first line connecting the main positive and negative sides between a resistor R1 and zener diode D1 in that line, and has between the main positive and negative sides in a second line in advance of the first line an anti-spiking varistor 73 and protects the negative side between the first and second lines against positive voltages by a diode D2. Within the regulated power supply, the circuit is divided into heater and solenoid subcircuits 74 and 75, respectively, each including as an integrated circuit or chip half of an 8-pin dual OP AMP No. 358 current differencing amplifier. Designated as OA1, the half chip or integrated circuit for the heater subcircuit 74 has as its four pins, output pin 1, inverting input pin 2, non-inverting input pin 3, and ground pin 4 as ground for both halves. The other half, designated as OA2, has as its four pins non-inverting supply pin 5, inverting supply pin 6, output pin 7, and supply pin 8 supplying power for both halves.

Considering first the heater subcircuit 74, inverting supply pin 2 is supplied temperature-responsive power by tapping between a thermistor T and potentiometer P, while the voltage to the non-inverting input 3 is obtained by tapping between voltage-dividing 47K resistors R2 and R3. Chip OA1 is off so long as the voltage on inverting pin 2 is greater than that on non-inverting pin 3, the normal condition obtained by regulating the 10K potentiometer P to preset or predetermine the turn on temperature, so long as the ambient temperature sensed by the thermistor T is substantially above freezing. However, as the temperature drops below that point, the resistance of the thermistor T increases, dropping the voltage on pin 2 below that on pin 3 and turning on OA1, in turn turning on the transistor Q1 and by grounding or rendering conductive the line in which Q1 and the heater 68 are connected in series, turning on the heater. At the same time, current is fed back from the output pin 1 to input pin 3, thus further increasing the voltage on pin 3 relative to that on pin 2. This alternate heater-on condition obtains until the ambient temperature on the thermistor T rises above the turn on temperature and the voltage on pin 2 again exceeds that on pin 3.

The solenoid subcircuit 75 containing the chip OA2 is considerably more complicated in both components and operation. In that subcircuit, a 47 YF timing capacitor C1 connected to inverting input pin 6 of integrated half chip OA2, has two charging paths, one through 51K resistor R5 and discharge-protecting diode D3, and the other from pin 7 of OA2 through discharge-protecting diode D4 and 10K resistor R6 and, as a discharge path. 0.5 M resistor R7 and pin 7 of OA2, the latter, when OA2 is turned off, being grounded through pin 4 of OA1 to the circuit's negative side 71. The solenoid 26 is connected between the primary positive side 70 of the circuit 67 and the negative side 71 in series with a power transistor Q2 matched in current capacity to the solenoid 26. Transistor Q2 has its base connected through suitable resistance to pin 7 of OA2 and is protected from spikes or current surges by a free-wheeling diode D5.

With pins 5 and 6 of half chip OA2 respectively the non-inverting and inverting inputs and pin 5 connected between voltage-dividing 47K resistors R8 and R9 in a line from the secondary positive side 72 and the negative side 71 and also to pin 7 of half chip OA2 through 24K resistor R10, the voltage on pin 5 will vary from 6 v. when OA2 is off to 16 v. when OA2 is on and the then 24 v. output voltage of pin 7 is fed back through the 24K resistor R10 to pin 5.

The lead 64 of the illustrated probe 58 is connected through a 1 M resistor R11 to th base of a grounding transistor Q3 wired in series with the resistor R5 between the secondary positive side 72 and negative side 71 of the control circuit 67 and, ahead of the resistor R11, is connected in parallel with a capacitor C2 providing a time lag in both turning on and turning off of the transistor Q3. When the probe 58 senses by contact therewith the presence to its level of a mainly water or other electrically conductive accumulation in the sump 57, the accumulation, being conductive, transmits to the probe 58 the 37 v. voltage carried by the locomotive's frame and after the time lag produced by the capacitor C2, turns on the transistor Q3, thus grounding the current through the resistor R5 and blocking charging of the timing capacitor C1 through resistor R5 and diode D3. At that point, the timing capacitor C1 discharges through the high resistance resistor R7, a matter of about 20 seconds, and, by reducing the voltage on pin 6 to substantially zero and thus below the 6 volts on pin 5, turns on OA2 and supplies from pin 8 an output voltage of 24 v. to pin 7.

With pin 7 now a power source, current fed back from it through resistor R10 increases the voltage on pin 5 to 16 v. and at the same time, by turning on the power transistor Q2, energizes the solenoid 58 by 74 v. dc current flowing to it through the circuit's main positive side 70. In turn, the energized solenoid opens the drain valve 10 by unseating the valve member 13, enabling the mainly aqueous matter accumulated in the sump 57 to be drained or discharged through the valve under the pressure of the compressed air or other gas in the reservoir. Concurrently, the timing capacitor C1 is being charged from the pin 7 through the diode D4 and resistor R6 of its alternate charging path and, with the resistance of R6 suitably only about 10K, the charging time is brief, only about 0.2 seconds. When the timing capacitor C1 is charged, the voltage on pin 6 is about 24 v. and above the 16 v. maximum of pin 5, thus turning off OA2 and, by deenergizing the solenoid 58, causing the valve member 18 to close under the closing force differential exerted thereon by reservoir pressure.

If after the first discharge, the probe 58 still senses accumulated mainly aqueous or other electrically conductive matter in the sump 57, the cycle of the solenoid subcircuit 75 repeats itself, the timing capacitor C1 first discharging through the resistor R7 and pin 7 and, after a delay of about 20 seconds for the discharge, turning on OA2 and therethrough energizing the solenoid 58. On being recharged in about 0.2 seconds through its alternate charging path, the timing capacitor completes the second cycle by turning off OA2 and deenergizing the solenoid. So long as the probe 58 senses accumulated matter in the sump 57, the drain valve 10 under control of the solenoid subcircuit 75, continues to cycle between an open cycle of about 0.2 seconds and a closed cycle of about 20 seconds. With the open cycles so short and limited to times when the probe 58 senses accumulated matter, the loss of reservoir pressure in the operation of the drain valve 10, is minimal by contrast with the very substantial losses caused by prior automatic drain valves in alternating between open and closed cycles regardless of whether any matter has been accumulated durin its closed cycle.

Although designed with its solid state components for trouble-free service, if desired, the control circuit 67 can include for periodic testing of the solenoid subcircuit 75 a manual switch 76 connected on one side between the probe 58 and resistor R11 and on the other side to the mounting frame in a diesel locomotive installation or other suitable power source (indicated symbolically in the wiring diagram by a battery) and effective when closed to charge the base of the transistor Q3 independently of the probe 58.

From the above detailed description it will be apparent that there has been provided an improved solenoid-actuated drain valve for draining matter accumulated by separation from compressed air or other gas in a reservoir, which is so controlled in automatic operation as to remain closed except when a probe senses the presence of accumulated matter and then alternates between brief open and relatively long closed cycles until the accumulated matter has been drained below a predetermined sensing level. It should be understood that the described and disclosed embodiment is merely exemplary of the invention and that all modifications are intended to be included that do not depart from the spirit of the invention and the scope of the appended claims.

Having now described our invention, we claim:

1. A solenoid-actuated drain valve for draining matter accumulated by separation from compressed gas, comprising a valve body having inlet and drain ports connecting respectively to an outlet of a compressed gas reservoir and to atmosphere, valve means in said body for normally closing and alternately opening communication between said inlet and drain ports, solenoid means, said valve means opening and closing in response respectively to energizing and deengerizing of said solenoid means, means for sensing said accumulated matter, and control circuit means for energizing and deenergizing said solenoid means respectively on sensing of accumulated matter by said sensing means and on absence of said sensing, said control circuit means so long as said sensing means senses accumulated matter being adapted to cyclically control energizing and deenergizing of said solenoid means and responsive opening and closing of said valve means in cycles of predetermined duration.

2. A solenoid-actuated drain valve according to claim 1, wherein the open cycle of said valve means is of relatively short duration for conserving the supply of compressed gas in said reservoir.

3. A solenoid-actuated drain valve according to claim 2, wherein the accumulated matter is electrically conductive, a frame mounting the reservoir and the drain valve carries a dc electrical charge, the electrically conductive matter separated from the compressed gas in the reservoir is accumulated in a sump in advance of the valve body, the sensing means is a single electrode probe projecting downwardly into said sump and connected by a single lead to the control circuit means, and the probe on sensing the accumulated matter is rendered operative by current conducted thereto from the mounting frame means through the accumulated matter to permit the control circuit to energize the solenoid means and open the valve means.

4. The solenoid-actuated drain valve according to either of claims 1 and 3, wherein the control circuit means is a solid state printed circuit, and the drain valve includes a junction box mounted on a housing of the solenoid means and containing the printed circuit.

5. A solenoid-actuated drain valve according to claim 3, wherein the control circuit means is a solid state circuit, the electrically conductive matter separated from the compressed gas in the reservoir is accumulated in a sump in advance of the valve body, the sensing means is an electrode probe projecting downwardly into said sump, and the probe on sensing the accumulated matter is rendered operative by current conducted through said matter to permit the control circuit to energize the solenoid means and open the valve means.

6. A solenoid-actuated drain valve according to claim 5, including heater means mounted on the valve body for preventing said valve from freezing when exposed to freezing temperatures, and wherein the control circuit means includes a thermostatically controlled subcircuit responsive to ambient temperatures for energizing and denergizing said heater means, said subcircuit including means for adjusting the temperature below and above which said heater means is respectively energized and deenergized.

7. A solenoid-actuated drain valve according to claim 5, including means for mounting the drain valve on a reservoir, said mounting means having a passage therethrough normally open at opposite ends respectively to an interior of the reservoir and the inlet port of the valve body, wherein the valve means is differential piston means having an inner end presented to the inlet port means and exposed therethrough to reservoir pressure and an outer end of larger surface area sealed from the drain port means, and means for exposing said outer end to reservoir pressure and deriving therefrom a force differential acting in a closing direction on said piston means.

8. A solenoid-actuated drain valve according to claim 7, wherein the exposing means includes passage means in the piston means between the inner and outer ends thereof.

9. A solenoid-actuated drain valve according to claim 8, including spring means in the valve body acting inwardly on the differential piston means for holding the piston means in closed position when the pressure in the reservoir is too low to exert a differential force sufficient to hold the piston means in said position.

10. A solenoid-actuated drain valve according to claim 6, wherein the mounting means includes a mounting bracket mounting the valve body and an adapter for connecting an inlet end of the mounting bracket to the outlet of the reservoir, the part of the passage in the mounting means within the adapter is downwardly offset for correspondingly downwardly offsetting said mounting bracket and the drain valve, and the sump for the accumulated matter is in and the sensing probe is mounted on the adapter.

* * * * *